US005611002A

United States Patent [19]

Vogten et al.

[11] Patent Number: 5,611,002

[45] Date of Patent: Mar. 11, 1997

[54] METHOD AND APPARATUS FOR MANIPULATING AN INPUT SIGNAL TO FORM AN OUTPUT SIGNAL HAVING A DIFFERENT LENGTH

[75] Inventors: Leonardus L. M. Vogten; Chang X. Ma, both of Eindhoven, Netherlands; Werner D. E. Verhelst, Brussels, Belgium; Josephus H. Eggen, Eindhoven, Netherlands

[73] Assignee: U.S. Philips Corporation, New York, N.Y.

[21] Appl. No.: 924,726

[22] Filed: Aug. 3, 1992

[30] Foreign Application Priority Data

| | | | |
|---|---|---|---|
| Aug. 9, 1991 | [EP] | European Pat. Off. | 91202044 |
| Feb. 24, 1992 | [EP] | European Pat. Off. | 92200521 |

[51] Int. Cl.[6] ..... G10L 9/00; G10L 5/02

[52] U.S. Cl. ..... 395/2.76; 395/2.74; 395/2.77

[58] Field of Search ..... 381/36–53; 395/2, 395/2.1–2.87

[56] References Cited

U.S. PATENT DOCUMENTS

| | | | |
|---|---|---|---|
| 3,369,077 | 2/1968 | French et al. | 179/1 |
| 4,282,405 | 8/1981 | Taguchi | 179/1 SC |
| 4,559,602 | 12/1985 | Bates, Jr. | 395/2 |
| 4,596,032 | 6/1986 | Sakurai | 381/51 |
| 4,624,012 | 11/1986 | Lin et al. | 395/2.76 |
| 4,700,393 | 10/1987 | Masuzawa et al. | 381/51 |
| 4,704,730 | 11/1987 | Turner et al. | 381/36 |
| 4,710,959 | 12/1987 | Feldman et al. | 395/2.16 |
| 4,764,965 | 8/1988 | Yoshimura et al. | 395/2.87 |
| 4,845,753 | 7/1989 | Yasunaga | 381/38 |

(List continued on next page.)

FOREIGN PATENT DOCUMENTS

| | | | |
|---|---|---|---|
| 0372155 | 5/1989 | European Pat. Off. | G03B 31/04 |
| 0363233 | 9/1989 | European Pat. Off. | G10L 5/04 |
| 8303483 | 10/1983 | WIPO | G03B 31/00 |
| 9003027 | 3/1990 | WIPO . | |

OTHER PUBLICATIONS

Rangan et al, "a window based editor for digital video and audio"; Proceedings of the Twenty–Fifth Hawaii International Conference on System Sciences, pp. 640–648 vol. 2, 7–10 Jan. 1992.

E. P. Neuburg, "Simple pitch–dependent algorithm for high–quality speech rate rate changing", Journal of the Acoustical Society of America, vol. 63, No. 2, Feb. 1978, New York, pp. 624–625.

Application A.

"Measurement of pitch by subharmonic summation" by D. J. Hermes, 1988 j. Acouts. Soc. Am, pp. 257–264.

"Time–Domain Algorithms for Harmonic Bandwidth Reduction and Time Scaling of Speech Signals", IEEE vol. 27, No. 2, Apr. 1979, by D. Malah, pp. 121–133.

"Function of SPAC (Speech Processing System by Use of Autorcorrelation Function) and Fundamental Characteristics" by T. Takasugi et al, The Transactions of the IECE of Japan, vol. J62 No. 3, pp. 153–154.

*Primary Examiner*—Tariq R. Hafiz
*Attorney, Agent, or Firm*—Richard A. Weiss

[57] ABSTRACT

A method and an apparatus for manipulating an input signal (e.g., an audio equivalent signal) having a specific length to form an output signal having a different length. A chain of successive overlapping time windows is positioned with respect to the input signal; segment signals are derived from the input signal and the segment signals; and the output signal is synthesized by chained superposition of a sequence of the segment signals. Each of the windows (except for the first window in the chain) is positioned by incrementing a position of the window from a corresponding position of a preceding window in the chain by a time interval. That time interval is substantially equal to a principal period of periodicity of a portion of the input signal with respect to which the window will be positioned. The sequence of segment signals is derived from the segment signals by performing at least one of repeating and suppressing one or more of the segment signals.

15 Claims, 4 Drawing Sheets

U.S. PATENT DOCUMENTS

| | | | |
|---|---|---|---|
| 4,852,169 | 7/1989 | Veeneman et al. | 381/38 |
| 4,864,620 | 9/1989 | Bialick | 381/34 |
| 5,001,745 | 3/1991 | Pollock | 395/2.79 |
| 5,111,409 | 5/1992 | Gasper et al. | 395/2.69 |
| 5,157,759 | 10/1992 | Bachenko | 395/2.69 |
| 5,175,769 | 12/1992 | Hejna, Jr. et al. | 381/34 |
| 5,220,611 | 6/1993 | Nakamura et al. | 395/2.87 |
| 5,230,038 | 7/1993 | Fielder et al. | 395/2 |
| 5,321,794 | 6/1994 | Tamura | 395/2.69 |
| 5,327,498 | 7/1994 | Hamon | 381/51 |

METHOD AND APPARATUS FOR MANIPULATING AN INPUT SIGNAL TO FORM AN OUTPUT SIGNAL HAVING A DIFFERENT LENGTH

BACKGROUND OF THE INVENTION

The invention relates to a method for manipulating an audio equivalent signal, comprising positioning a chain of mutually overlapping time windows with respect to the audio equivalent signal on the basis of periodicity measurements of the audio equivalent signal so that a positional displacement between adjacent windows substantially corresponds to a principal period of said periodicity; and synthesizing an audio output signal by chained superposition of segment signals derived from the audio equivalent signal through weighting with the windows (i.e., an associated window function for each). Such a method has been described in earlier non pre-published European Application 91202044.3 (to which U.S. Pat. No. 5,479,564 corresponds), co-authored by the present inventors and assigned to the same assignee, which reference is incorporated herein by reference, inasfar as not actually included. Reference should also be made of a still earlier, pre-published reference, i.e., European Patent Application EP-A-363 233. The object of those references was to change the prosody for synthesized speech, the pitch of the output signal, and the duration of stretches of speech. In combination with the junior reference (i.e., European Application 91202044.3), the method should be performed automatically, be robust against noise, and retain a high audio quality for the output signal. The inventors of the present invention have realized that the manipulation of the duration can be used in various situations where there are external constraints to the total length of a self-contained unit of speech, which constraints may specify both the maximum and the minimum duration of such unit.

SUMMARY OF THE INVENTION

Accordingly, inter alia, it is an object of the present invention to position a manipulated audio equivalent signal in a predetermined time length that differs from the original time length, while on the one hand filling the interval more or less completely, and on the other hand keeping the impression of the eventual representation as natural as possible.

This object is realized in accordance with the invention in a method comprising the method described in the opening paragraph and by manipulating a duration of the output signal through systematically repeating, maintaining, and/or suppressing the segment signals to a resulting predetermined overall length that differs from a corresponding duration of the audio equivalent signal.

An advantage of a method employing positioning windows according to the junior reference is that it can be machine-executed without any window-to-window human control being necessary. Furthermore, it has been found that the duration can be changed by a factor between 2 and ½ without seriously impairing understandability of speech. For lesser degrees of manipulating the duration, such as by + or −30%, not only does the understandability remain very good, but also, the natural quality of the speech is maintained; and to a listener the change of duration will feel natural. A prerequisite to applying the method is that the pitch can be measured, which for human speech is a problem knowing various solutions.

Situations where the duration of speech should be manipulated are various, such as in post-synchronizing of movies or other video representative material, adapting a speech explanation or other matter to physical motion of objects (such as the instant of closing a door) and many other instances. In movies, actor utterances should preferably coincide with their facial motions, or at least with their moving around in general. Typical time scales of the total duration of the utterance are 0.3 to several seconds. In this short time frame, the prior art has not succeeded in duration manipulation which preserves naturalness. On a much longer time scale, the length of a pause can be manipulated, such as is often done by human interpreters. If the available time is known beforehand, sometimes a different verbalization can be used, but all of these methods require specialized human skills. The method in accordance with the invention is easily applicable, and it only requires the setting of a speed-up or slow-down percentage. Of course, the use of the present invention is also for amending longer durations than those in the seconds range.

The invention relates also to an apparatus for executing the method and to a storage medium containing a representation of the audio equivalent signal. The invention allows available space for a unit of speech (e.g., a sentence, a partial sentence, an exclamation, or another) to be filled almost completely.

A particular application of the invention is for use with Compact Disc Interactive (CD-I), especially when CD-I is being used in a multi-language environment. Editing CD-I is by itself a complicated task. As a result of the invention, sizing the duration of speech utterances may be performed by a machine, relieving the program editor from this tedium. By itself, CD-I is a well-published storage medium with associated development platform, the storage itself being an extension from Compact Disc Audio.

BRIEF DESCRIPTION OF THE DRAWINGS

These and other advantages will be further described with reference to a preferred embodiment which is shown in a number of figures, in which

(FIGS. 2–6 show the technology of the junior reference.)

DETAILED DESCRIPTION OF A PREFERRED EMBODIMENT

As is commonly understood, an audio or speech equivalent signal may be a direct analog speech, or it may be speech that is stored as a sequence of codes for generating synthetic speech.

The length of the various windows may be non-uniform, and in a particular embodiment, the length of each window may be substantially equal to an actual local pitch period length. Within a window, the window function is uniform, which means that the window function scales linearly with the width of the window. This in turn means that generally there may be an appreciable variation between the widths of successive windows.

The systematical character of repeating, maintaining, or suppressing implies that there is a certain prescription for the sequence of window positions. That prescription involves either repeating or suppressing, possibly in combination with maintaining, and the repeating or maintaining is done under control of an actual or emulated recurrent cycle. Examples of that prescription are:

(a) each third window is repeated once, and the others are maintained:

(b) for each five successive windows, #2 and #4 are suppressed; and (c) at each next window, a count is incremented by a particular amount and overflow controls actual suppression or repetition.

It is commented that the systematical character need not be completely uniform. For example, in post-synchronization of a movie, it could be advantageous to amend the time durations of various parts of a sentence somewhat differently from each other, as long as the natural character of the resulting speech remains. In particular, the movement of a face while speaking speech could to a certain extent be followed by the dynamics of the audio speech. Also, different sentences in various places of the post-synchronization may as a result of the invention have uniform pitch among each other.

The different representations in parallel may be in different languages. It has been found that the same sentence, translated to another language, would have a different length, counted, for example, as a number of syllables. In particular, the German language causes a longer duration as compared with English and French. Other languages, in particular exotic languages, may lead to even more extreme situations. Similar situations may distinguish child voices from adult voices.

Figure 1:
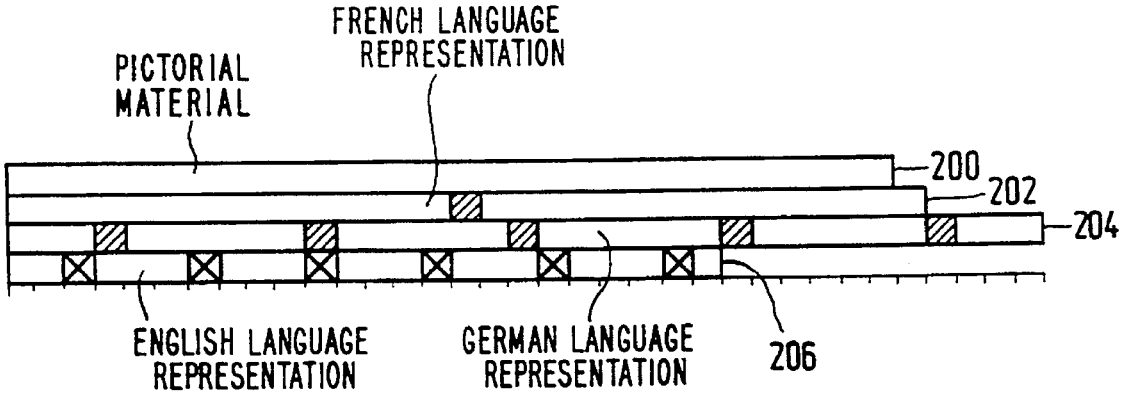
FIG. 1 shows editing of a CD-I program for storage on a CD-I disc.

In FIG. 1, a three language CD-I track is shown. Specifically, pictorial material 200 is shown with accompanying speech representations in French (202), German (204) and English (206) before final editing. It is the intent that each language representation (among which a user may choose) be given exactly the same duration as the pictorial material (movie, animation, etc). The manner in which this is done for the CD-I track shown in FIG. 1 is as follows: on line 202, a single window is suppressed; on line 204, five windows are suppressed; and on line 206, six windows are repeated once (crosses). The final results after editing are not shown.

It has been found that analysis of the results can be used to determine if the method of the invention has been used. This is especially true with the occurrence of the repeated windows, which is well traceable. Moreover, the substantially equal lengths of the various representations, together with the high subjective quality of the rendering, is a clear indication of use of the present technology.

In certain situations, apart from changing the duration per se, the slowing down or speeding up may give the speech a certain character, such as a nervous (fast) or a majestic (slow) quality. Such a use is sometimes advantageous.

Changing the duration of the audio equivalent signal may be combined with changing the pitch. These two types of manipulation may both be in the same direction, for example. In that case, both effectively shorten the duration. In other circumstances, they may, to some degree, compensate for the effects of the other, so that the change in duration would be less or even zero. The change of duration may be according to a time-varying pattern, whereby the overall change of duration is the integral or sum of the elementary changes-of-duration.

Figure 2A:
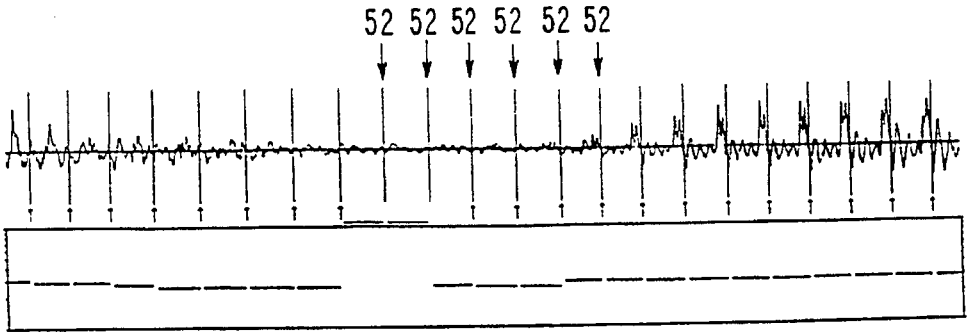
FIGS. 2*a, b* and *c* show speech signals with windows placed according to the invention.
Figure 2B:
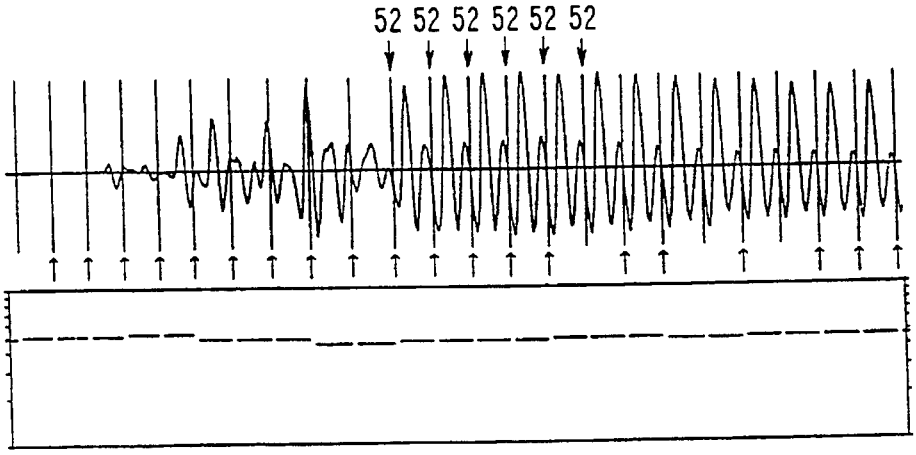
Figure 2C:
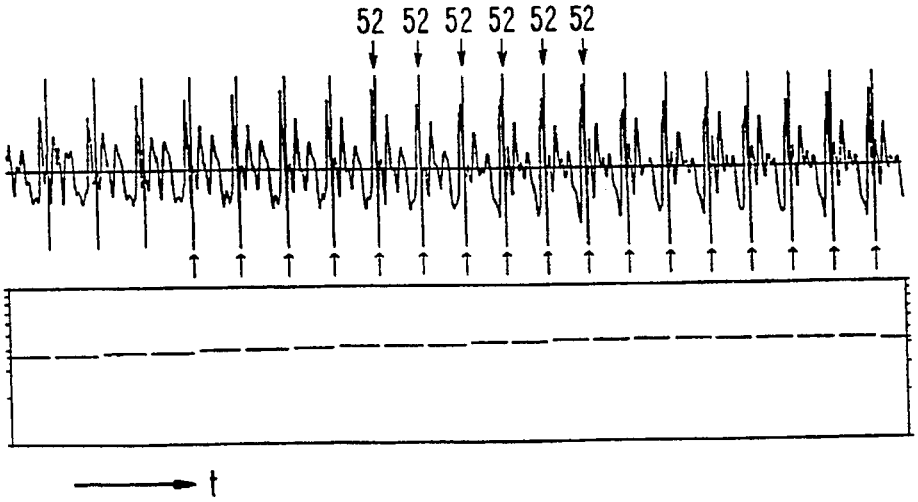

FIGS. 2*a, b* and *c* show speech signals with marks 52 placed apart by distances determined with a pitch meter (that may be conventional), i.e., without a fixed phase reference. In FIG. 2*a,* two successive periods where marked as voiceless by placing their pitch period length indication outside the scale. The pitch marks (lower scale) where obtained by interpolating the period length. Although the pitch period lengths were determined without smoothing, other than that inherent in determining spectra of the speech signal extending over several pitch periods, a very regular curve was obtained automatically.

The incremental placement of windows also solves another problem. For unvoiced stretches that contain fricatives like the sound "ssss", in which the vocal cords are not excited, the windows are placed incrementally just like for voiced stretches. The pitch period length is interpolated between the lengths measured for unvoiced stretches adjacent to the voiced stretch. This provides regularly spaced windows without audible artefacts.

The placement of windows is easy if the input audio equivalent signal is monotonous. In that case, the windows may be placed simply at fixed distances from each other. This may be effected by preprocessing the signal so as to change its pitch to a single monotonous value. The final manipulation to obtain a desired pitch and/or duration can then be performed with windows at uniform spacing.

Figure 3:
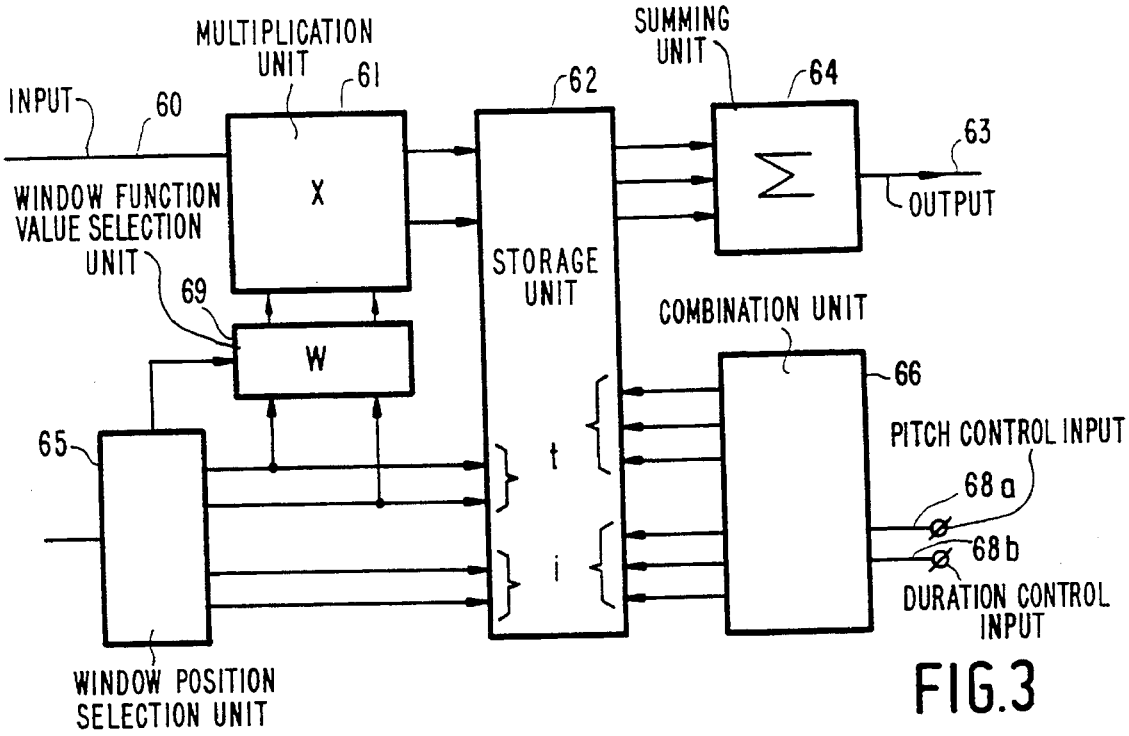
FIG. 3 shows an apparatus for changing the pitch and/or duration of a signal.

FIG. 3 shows an exemplary embodiment of an apparatus for changing the pitch and/or duration of an audible signal. The input audio equivalent signal arrives at an input 60, and the output signal leaves at an output 63. The input signal is multiplied by a window function in a multiplication unit 61, and stored segment signal by segment signal in segment slots in a storage unit 62. To synthesize the output signal at output 63, speech samples from various segment signals are summed in a summing unit 64. The manipulation of speech signals, in terms of pitch change and/or duration manipulation, is effected by addressing the storage unit 62 and selecting window function values. Selection of storage addresses for storing the segment signal, is controlled by a window position selection unit 65, which also controls a window function value selection unit 69. Selection of readout addresses is controlled by a combination unit 66.

In order to explain the operation of the components of the apparatus shown in FIG. 3, it is briefly noted that signal segments $S_i$ are derived from an input signal X(t) (at 60), the segment signals being defined by:

$$S_i(t)=W(t/L_i)\ X(t+t_i)\ (-L_i<t<0)$$

$$S_i(t)=W(t/L_{i+1})X(t+t_i)\ (0<t<L_{i+1}),$$

and that those segment signals are superposed to produce an output signal Y(t) (at 63) defined by:

$$Y(t)=\Sigma_i'\ S_i(t-T_i)$$

(the sum being limited to indices i for which $-L_i<t-T_i<L_{i+1}$). At any point in time t', a signal X(t') is supplied at the input 60 which contributes to two segment signals i and i+1 at respective t values $t_{a=t'-ti}$ and $t_b=t'-t_{i+1}$ (these being the only possibilities that $-L_i<t<L_{i+1}$).

Figure 4:
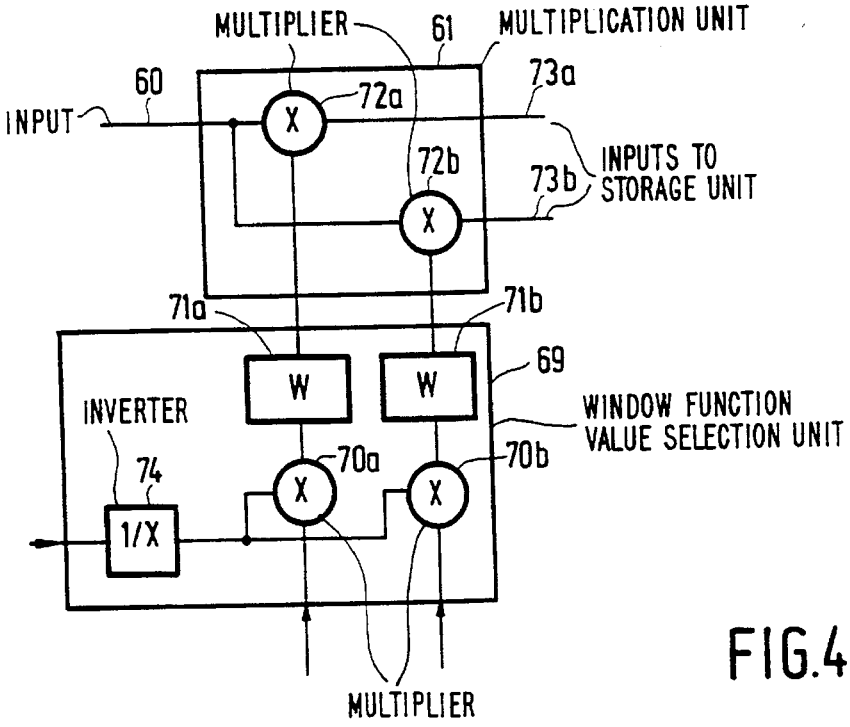
FIG. 4 shows a multiplication unit and a window function value selection unit for use in an apparatus for changing the pitch and/or duration of a signal.

FIG. 4 shows the multiplication unit 61 and the window function value selection unit 69. The respective t values $t_a$ and $t_b$, descried above, are multiplied by the inverse of a period of length $L_{i+1}$ (determined from the period length in an invertor 74) in scaling multipliers 70*a* and 70*b* to determine the corresponding arguments of the window function W. These arguments are supplied to window function evaluators 71*a* and 71*b* (implemented, for example, in case of discrete arguments as a lookup table) which output the corresponding values of the window function. Those values of the window function W are multiplied with the input signal in two multipliers 72*a* and 72*b*. This produces the segment signal values $S_i$ and $S_{i+1}$ at two inputs 73*a* and 73*b* to the storage unit 62.

Figure 5:
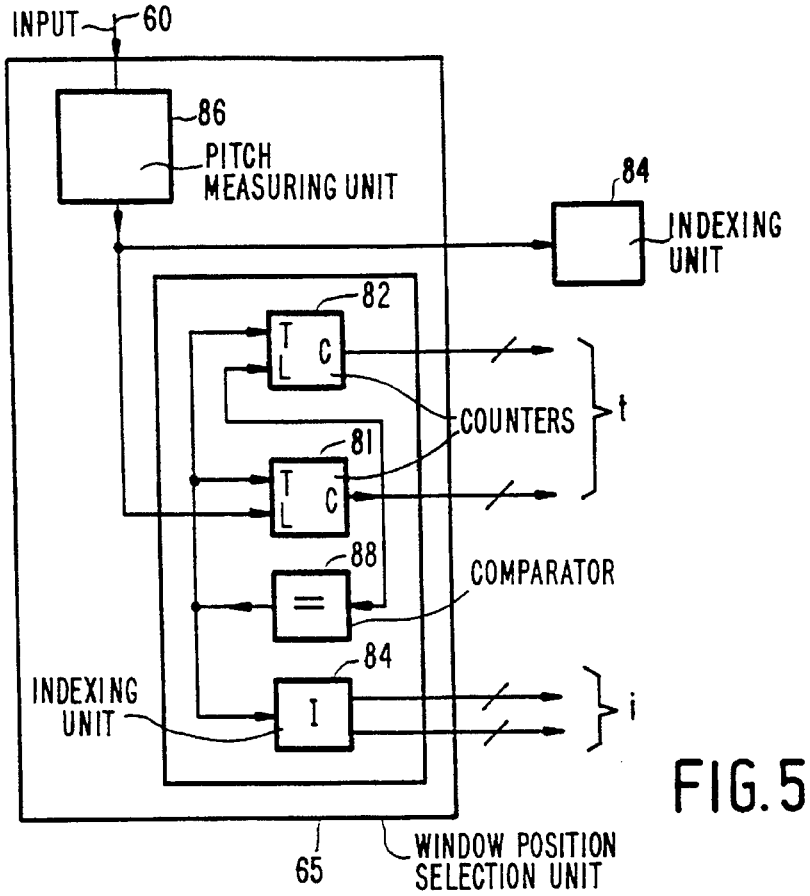
FIG. 5 shows a window position selection unit for implementing the invention.

These segment signal values are stored in the storage unit 62 in segment slots at addresses in the slots corresponding to their respective time point values $t_a$ and $t_b$ and to respective slot numbers. These addresses are controlled by the window position selection unit 65. A window position selection unit suitable for implementing the invention is shown in FIG. 5. The time point values $t_a$ and $t_b$ are addressed by counters 81 and 82 and the slot numbers are addressed by an indexing unit 84, which outputs the segment indices i and i+1. The counters 81 and 82 and the indexing unit 84 output addresses with a width appropriate to distinguish the various positions within the segment slots and the various slot, respectively (but are shown symbolically only as single lines in FIG. 5).

The two counters 81 and 82 of FIG. 5 are clocked at a fixed clock rate and count from an initial value loaded from a load input (L), upon receiving a trigger signal at trigger input (T). The indexing unit 84 increments the index values upon receiving this trigger signal.

According to one embodiment, a pitch measuring unit 86 determines a pitch value from the input 60, controls the scale factor for the scaling multipliers 70*a* and 70*b*, and provides the initial value of the first counter 81 (the initial count being minus (i.e., the negative of) the pitch value). The trigger signal is generated internally in the window position selection unit 65, once the counter 81 reaches zero, as detected by a comparator 88. This means that successive windows are placed by incrementing the location of a previous window by the time needed for the first counter 81 to reach zero.

In another embodiment, a monotonized signal is applied to the input 60 (this monotonized signal being obtained by prior processing in which the pitch is adjusted to a time independent value). In this monotonized case, a constant value, corresponding to the monotonized pitch is fed as the initial value to the first counter 81. In this monotonized case, the scaling multipliers 70*a* and 70*b* can be omitted since the windows have a fixed size.

Figure 6:
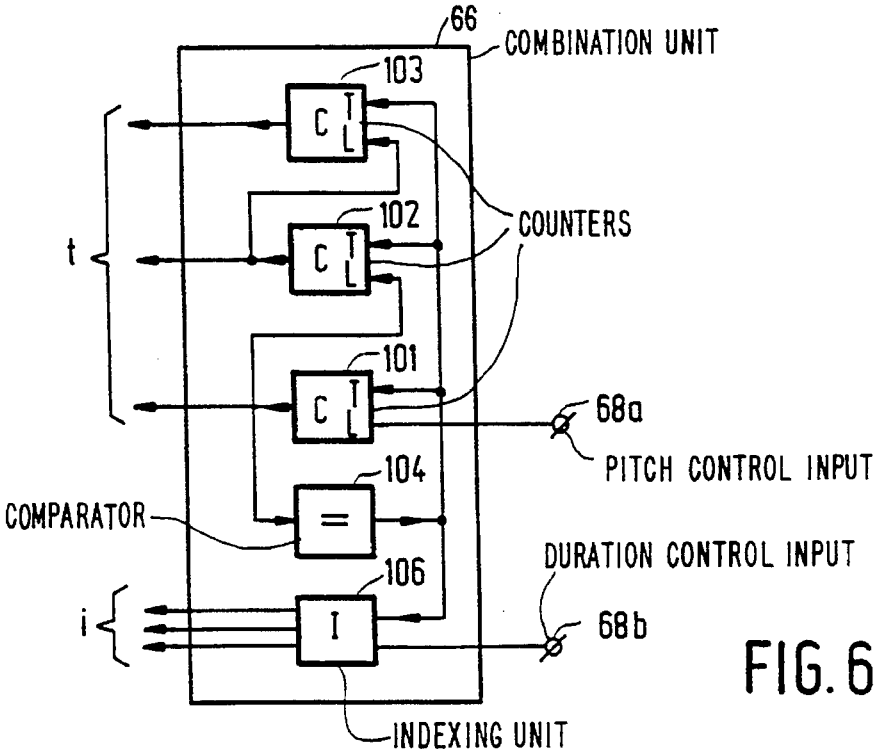
FIG. 6 shows a subsystem for combining several segment signals.

The combination unit 66 of FIG. 3 is shown in FIG. 6. The purpose of the outputs of this unit is to superpose segment signals from the storage unit 62 according to $$Y(t)=\Sigma_i' S_i(t-T_i)$$

(the sum being limited to index values i for which $$-L_i<t-T_i<L_{i+1}).$$

In principle, any number of index values may contribute to the sum at one time point t, but when the pitch is not changed by more than a factor of ⅔, at most 3 index values will contribute at a time. By way of example, therefore, FIGS. 3 and 6 show an apparatus which provides for only three active indices at a time. Extension to more than three segments is straightforward).

For addressing the segment signals, the combination unit 66 comprises three counters 101, 102 and 103 (clocked at a fixed rate), outputting the time point values $t-T_i$ for three segment signals. The three counters 101, 102 and 103 receive the same trigger signal which triggers loading of minus (i.e., the negative of) the desired output pitch interval in the first of the three counters 101. Upon receipt of the trigger signal, the last position of the first counter 101 is loaded into the second counter 102, and the last position of the second counter 102 is loaded into the third counter 103. The trigger signal is generated by a comparator 104, which detects zero crossing of the first counter 101. The trigger signal also updates the indexing unit 106.

The indexing unit 106 addresses the segment slot numbers which must be read out and the counters 101, 102 and 103 address the positions within the slots. The counters 101, 102 and 103, and the indexing unit 106 address three segments, which are output from the storage unit 62 to the summing unit 64 in order to produce the output signal.

By applying desired pitch interval values at a pitch control input 68*a*, one can control the pitch value. The duration of the speech signal is controlled by a duration control input 68*b* to the indexing unit 106. Without duration manipulation, the indexing unit 106 simply produces three successive segment slot numbers. Upon receipt of the trigger signal, the values of the first and second outputs i are copied to the second and third outputs i, respectively, and the first output i is increased by one. When the duration is increased, the first output is kept constant once every so many cycles, as determined by the duration control input 68*b*. To decrease the duration, the first output is increased by two every so many cycles. The change in duration is determined by the net number of skipped or repeated indices. When the apparatus of FIG. 3 is used to change the pitch and duration of a signal independently (for example changing the pitch and keeping the duration constant), the duration input 68*b* should be controlled to have a net frequency F at which indices should be skipped or repeated according to $$F=(D\ t/T)-1,$$

where D is the factor by which the duration is changed, t is the pitch period length of the input signal and T is the period length of the output signal. A negative value of F corresponds to skipping of indices, while a positive value corresponds repetition).

FIG. 3 only provides one embodiment in accordance with the invention by way of example. The principal point of the invention is the incremental placement of windows based on a previous window.

In addition, there are many ways of generating the addresses for the storage unit 62, of which FIG. 5 is but one. For example, the addresses may be generated using a computer program, and the starting addresses need not have the values as given in the example discussed with FIG. 5.

Moreover, FIG. 3 can be implemented in various ways, for example, using digital samples at input 60, where the sampling rate has at any convenient value, for example, 10000 samples per second. Conversely, it may use continuous signal techniques, where the clocks 81, 82, 101, 102 and 103 provide continuous ramp signals, and the storage unit provides for continuously controlled access like a magnetic disk.

Furthermore, in FIG. 3, the segment slots may be reused after some time, as they are not needed permanently. In addition, not all components of FIG. 4 need to be implemented by discrete function blocks. Often, it may be implemented in whole or part by a computer.

We claim:

1. A method for manipulating an input signal having a specific length to form an output signal, said method comprising:

positioning a chain of successive overlapping time windows with respect to the input signal, each of the windows, except for the first window in the chain, being positioned with respect to the input signal by incrementing a position of the window from a corresponding position of a preceding window in the chain positioned with respect to the input signal by a time interval which is substantially equal to a principal period of periodicity of a portion of the input signal with respect to which the window will be positioned, said incrementing thereby determining where the window is positioned with respect to the input signal;

deriving segment signals from the input signal and the windows, each of the segment signals being derived by weighting the input signal as a function of position in a corresponding one of the windows; and synthesizing the output signal so that it has a predetermined length which differs from the specific length of the input signal by chained superposition of a sequence of the segment signals, the sequence being derived from the segment signals by performing at least one of repeating and suppressing one or more of the segment signals.

2. The method as claimed in claim 1, wherein the input signal is an audio equivalent signal.

3. The method as claimed in claim 1, wherein the predetermined length is equal to a length of an intermission between two non-manipulated signals.

4. The method as claimed in claim 1, wherein the input signal is an audio equivalent signal, the predetermined length is equal to the length of a video signal relating to the audio equivalent signal, and the sequence is derived so that the output signal is synchronized with the video signal.

5. The method as claimed in claim 1, wherein the input signal is an audio equivalent signal, and the principal period of periodicity is a pitch period.

6. A unitary storage medium for storing the output signal formed by the method of claim 1.

7. A method of manipulating a plurality of input signals so as to form respective output signals therefrom having the same lengths, each respective output signal being formed by manipulating a different one of the input signals in accordance with the method of claim 1.

8. The method as claimed in claim 7, wherein the input signals are audio equivalent signals relating to the same matter but having different representations.

9. The method as claimed in claim 7, wherein the input signals are audio equivalent signals which each relate to the same matter but correspond to a different language.

10. A unitary storage medium for storing the output signal formed by the method of claim 7.

11. An apparatus for manipulating an input signal having a specific length to from an output signal, the apparatus comprising:

positioning means for positioning a chain of successive overlapping time windows with respect to the input signal;

incrementing means for determining a position with respect to the input signal with which each of the windows, except for the first window in the chain, is to be positioned by said positioning means by incrementing from a corresponding position of a preceding window in the chain positioned with respect to the input signal by a time interval which is substantially equal to a principal period of periodicity for a portion of the input signal with respect to which the window will be positioned;

segmenting means for deriving a plurality of segment signals from the input signal and the windows, each of the segment signals being derived by weighting the input signal as a function of position in a corresponding one of the windows; and synthesizing means for synthesizing the output signal so that it has a predetermined length which differs from the specific length of the input signal by chained superposition of a sequence of the segment signals, the sequence being derived from the segment signals by performing at least one of repeating and suppressing one or more of the segment signals.

12. The apparatus as claimed in claim 1, wherein the input signal is an audio equivalent signal.

13. The apparatus as claimed in claim 11, wherein the predetermined length is equal to a length of an intermission between two non-manipulated signals.

14. The apparatus as claimed in claim 11, wherein the input signal is an audio equivalent signal, the predetermined length is equal to the length of a video signal relating to the audio equivalent signal, and the sequence is derived so that the output signal is synchronized with the video signal.

15. The apparatus as claimed in claim 11, wherein the input signal is an audio equivalent signal, and the principal period of periodicity is a pitch period.

* * * * *